United States Patent [19]

Mutschler

[11] Patent Number: 4,461,591

[45] **Date of Patent: * Jul. 24, 1984**

[54] INK WRITING IMPLEMENT

[76] Inventor: Otto Mutschler, Rudolf-Krehl-Strasse, 21 Heidelberg, Fed. Rep. of Germany, D-6900

[ * ] Notice: The portion of the term of this patent subsequent to Jun. 28, 2000 has been disclaimed.

[21] Appl. No.: 346,621

[22] Filed: Feb. 8, 1982

[30] Foreign Application Priority Data

Mar. 17, 1981 [DE] Fed. Rep. of Germany ..... 3110199

[51] Int. Cl.[3] ..... B43K 5/16; B43K 1/06; B43K 1/10

[52] U.S. Cl. ..... 401/258; 401/259

[58] Field of Search ..... 401/258, 259, 260

[56] References Cited

U.S. PATENT DOCUMENTS 3,442,597 5/1969 Hebborn et al. ..... 401/259
4,390,299 6/1983 Mutschler ..... 401/258

FOREIGN PATENT DOCUMENTS 1911950 9/1970 Fed. Rep. of Germany ..... 401/259
2460345 7/1975 Fed. Rep. of Germany ..... 401/258

*Primary Examiner*—Steven A. Bratlie
*Attorney, Agent, or Firm*—Kurt Kelman

[57] ABSTRACT

An ink writing implement comprises a retainer for a floating weight arranged in the axial bore of a retaining box and having an annular planar surface facing a planar shoulder therein. A venting groove and capillary grooves pierce the surface and the retainer includes a spiral ink flow path along the circumference thereof. A floating weight is guided for axial movement in the axial bore of the retainer and the planar shoulder forms an abutment for a front end of the floating weight. The retainer bore is long enough to accommodate the axial movement of the floating weight and this weight defines an axially extending venting channel with the retainer. A front retainer end is cylindrically recessed and comprises a surface defining an ink flow control path in the axial bore of the retaining box, which connects the venting groove and channel with the spiral ink flow path. Because of the length of the retainer in the retaining box, the height of the ink column in the box is considerably shortened so that the capillary forces required for the control of the ink flow may be relatively small.

3 Claims, 9 Drawing Figures

INK WRITING IMPLEMENT

Figure 1:
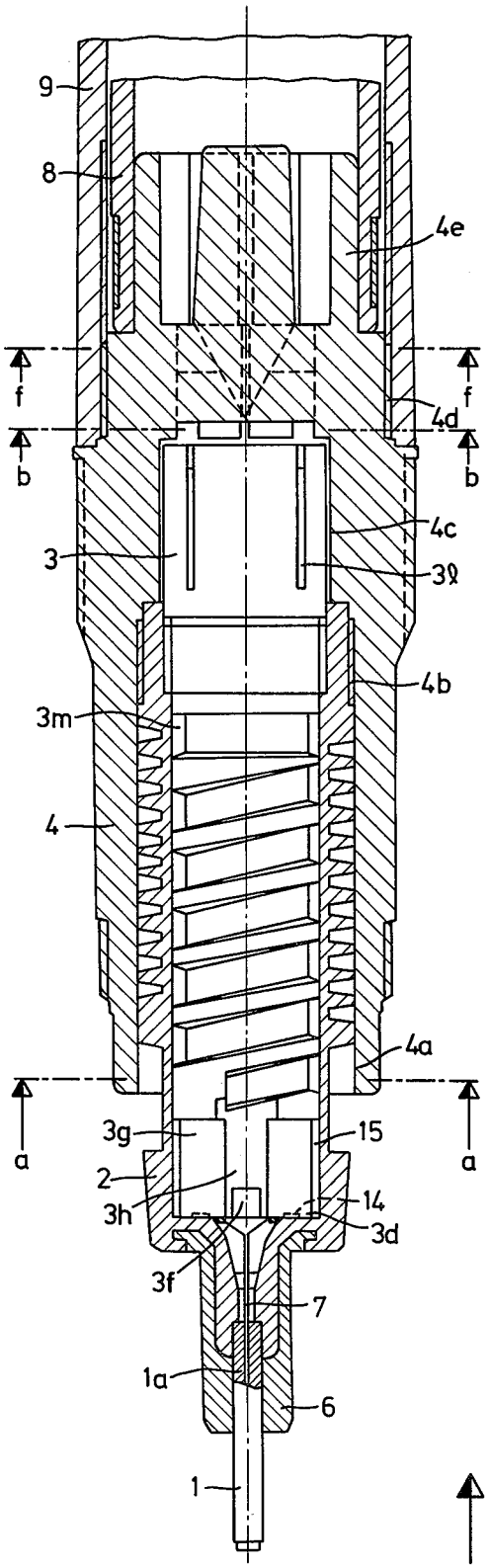

The present invention relates to improvements in an ink writing implement, such as an India ink drawing pen, a marker pen with a fibrous tip or a ball-point pen.

U.S. Pat. No. 3,442,597 discloses a cartridge pen with an axially positioned writing point receiving ink from an ink flow channel delimited by a liquid supply tube, the ink flow channel being in communication with a concentric equilibrium channel through an air entry port, the chamber being in communication with the atmosphere through a venting port adjacent the tubular front portion having an outer end holding the writing point. The connecting port between the ink channel and the annular equilbrium chamber is arranged at the front end of the liquid supply tube and the venting port leads into a connecting bore at an end of the chamber facing away from the writing point. A sleeve portion concentrically surrounding the liquid supply tube and delimiting the equilibrium chamber forms a separate part integral with the tubular front portion holding the writing point.

In my U.S. patent application Ser. No. 297,739, filed Aug. 31, 1981, now U.S. Pat. No. 4,390,299 I have disclosed and claimed an India ink drawing implement comprising a tubular front portion having an outer end and an interiorly threaded inner end, the tubular front portion defining an axial bore, and a tubular drawing point affixed to the outer end of the tubular front portion for receiving India ink from the axial bore of the tubular front portion. A retainer for a floating weight is threadedly fastened to the threaded inner end of the tubular front portion and defines an axial bore in axial alignment with the axial bore of the tubular front portion. The retainer comprises an elongated tubular portion extending through the tubular front portion bore and a bottom closing an inner end of the retainer. A floating weight is guided for axial movement in the axial retainer bore and a portion of the tubular front portion bore, the length of the tubular retainer portion being sufficient to guide a major portion of the floating weight and the bottom of the retainer limiting the stroke of the axial movement of the floating weight. While the capacity of the ink control system of this implement is sufficient at large temperature differentials and with a small amount of ink stored in the reservoir, that is, with a large column of air in the reservoir, and the formation of drops at the drawing point has been largely reduced even when the pressure in the ink reservoir increases, some drop formation still takes place at high temperature in implements designed for drawing or writing thick lines.

It is the primary object of this invention to improve on this type of drawing or writing implement and to provide such an implement with an ink flow which is not under undue pressure at high temperatures and, therefore, forms no drops at the tip of the writing or drawing point.

This and other objects are accomplished according to the invention with an ink writing implement which comprises a tubular front portion having an outer end holding a writing point and defining an axial bore, a planar shoulder extending between the outer tubular front portion end and the axial bore thereof. A retainer for a floating weight is arranged in the axial bore of the tubular front portion, the retainer defining an axial bore coaxial with the axial bore of the tubular front portion and having an annular planar surface facing the planar shoulder, the annular planar surface being pierced by a venting groove extending in an axial direction and capillary grooves extending along the surface, and the retainer including a spiral ink flow path along the circumference thereof. A floating weight is guided for axial movement in the axial bore of the retainer, the planar shoulder of the tubular front portion forming an abutment for a front end of the floating weight and the axial bore in the retainer being of sufficient length to accommodate the axial movement of the floating weight, the floating weight defining an axially extending venting channel with the retainer, a front end of the retainer being cylindrically recessed and the recessed retainer front end comprising a surface defining an ink flow control path in the axial bore of the tubular front portion the ink flow control path connecting the venting groove and channel with the spiral ink flow path.

This arrangement has the advantage that the cylindrically recessed front end of the retainer extends the floating weight retainer to the planar shoulder of the tubular front portion within the axial bore thereof so that the height of the ink columns in the flow path in the tubular front portion is substantially shortened, thus making it possible to reduce the capillary forces required for the ink flow control substantially.

Figure 2:
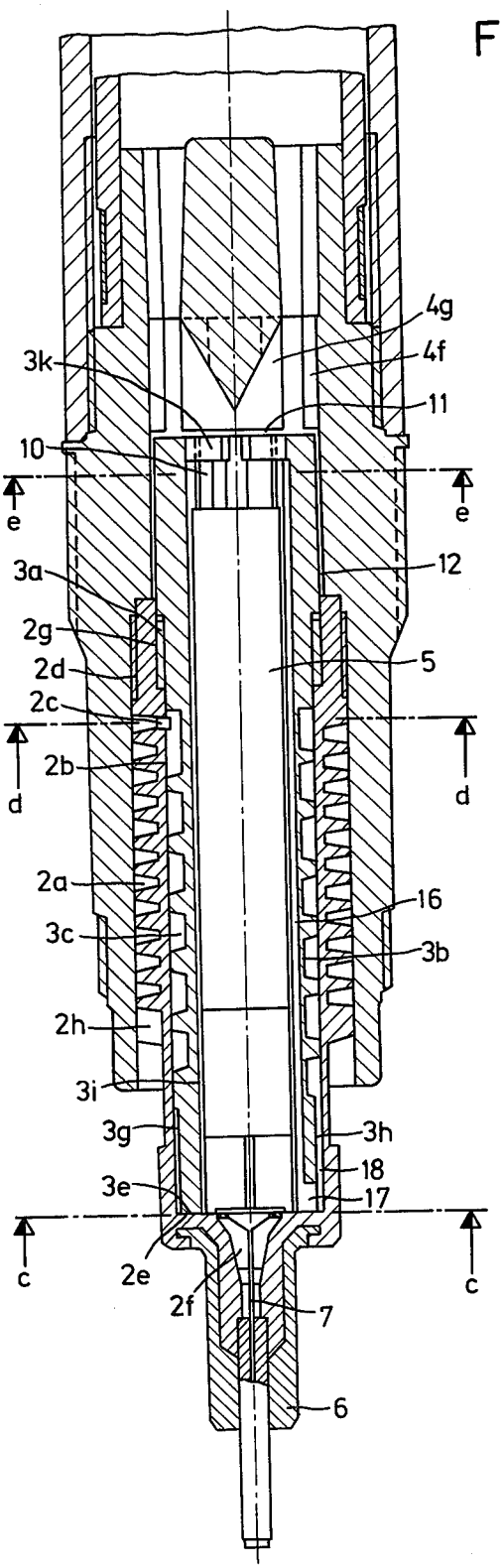
Figure 3C:
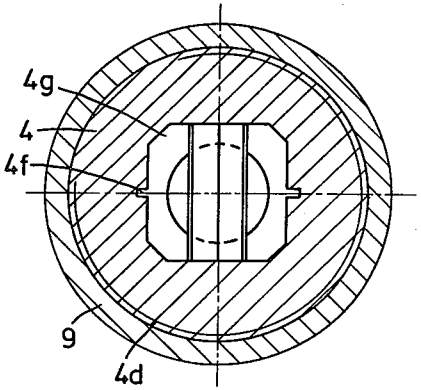
Figure 3B:
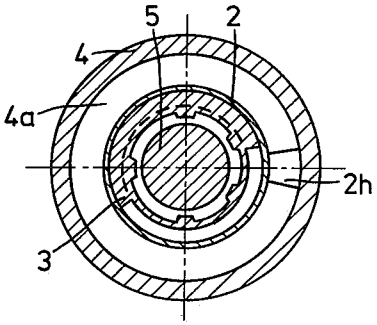
Figure 3A:
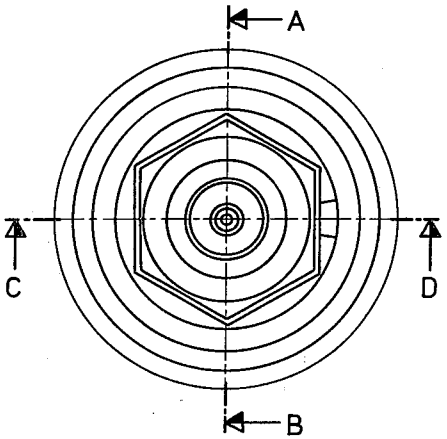
Figure 4C:
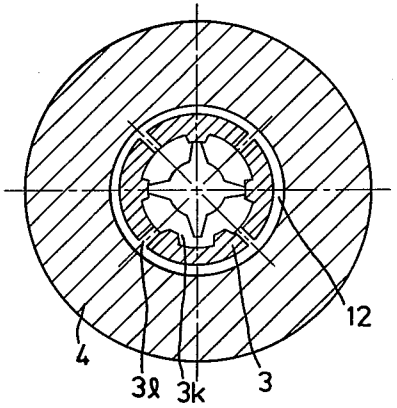
Figure 4B:
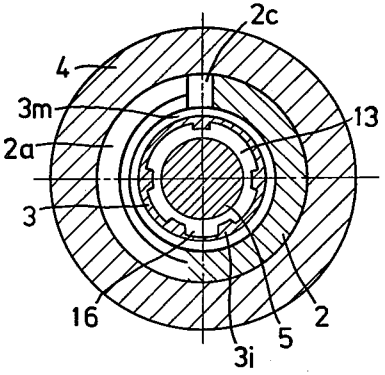
Figure 4A:
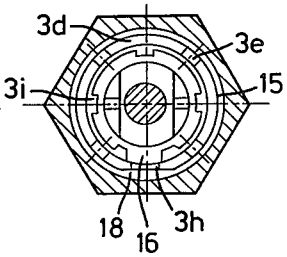
Figure 5:
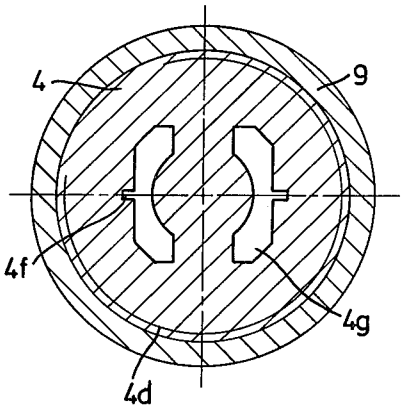

The above and other objects, advantages and features of the present invention will become more apparent from the following detailed description of a now preferred embodiment of this invention, taken in conjunction with the accompanying drawing wherein FIG. 1 shows an axial section of the front portion of an India ink drawing implement incorporating the invention;

FIG. 2 is a like sectional view, with the implement turned about its axis by 90°;

FIG. 3*a* is a front view of this implement;

FIGS. 3*b* and 3*c* are transverse sections along lines a—a and b—b of FIG. 1, respectively;

FIGS. 4*a*, 4*b* and 4*c* are, respectively, transverse sections along lines c—c, d—d and e—e of FIG. 2; and FIG. 5 is a section along line f—f of FIG. 1.

Referring now to the drawing, there is shown in ink writing implement which comprises tubular front portion 2 having an outer end holding a writing point constituted by tubular drawing tip 1 defining bore 1*a* for the outflow of ink therethrough. The retaining box defines axial bore 2*b* and planar annular shoulder 2*e* between the outer tubular front portion end and axial bore 2*b* thereof. Tubular drawing tip 1 is affixed to the outer end of tubular front portion 2 for receiving ink from narrowed, conical axial bore part 2*f* of the tubular front portion. In the illustrated embodiment, tubular drawing tip holder 6 is attached to the outer end of the tubular front portion and the drawing tip is frictionally held in the holder. In this embodiment, the inner end of tubular front portion 2 has an exterior threaded portion 2*d* for engagement with interior threaded portion 4*b* of grip 4 so that the tubular front portion is detachably fastened to the grip, extending through axial bore 4*a* in the grip. The inner end of the tubular front portion also has an interior threaded portion 2*g* engaging exterior threaded portion 3*a* of retainer 3 for floating weight 5 so that the floating weight retainer is detachably fastened to the tubular front portion.

Retainer 3 is arranged in axial bore 2*b* of tubular front portion 2 and defines an axial bore coaxial with axial bore 2*b* of the tubular front portion. The retainer has annular planar surface 3*d* facing annular planar shoulder 2e. The annular planar surface is pierced by venting groove 17 extending in an axial direction and a plurality of capillary grooves 14 extend along the surface. The retainer includes spiral ink flow path 3c in axial bore 2b of the tubular front portion and the spiral ink flow path extends along the circumference of elongated tubular skirt 3b of retainer 3.

As shown in FIG. 2, floating weight 5 is guided for axial movement in the axial bore of retainer 3 and is capable of executing a stroke whose extent is indicated by double-headed arrow 10, planar shoulder 2e of tubular front portion 2 forming an abutment for a front end of the floating weight and the axial bore in the retainer and its elongated tubular skirt 3b being of sufficient length to accommodate the entire axial movement of the floating weight. Floating weight 5 defines axially extending venting channel 16 with retainer 3 and front end 3g of the retainer is cylindrically recessed, as shown in FIG. 1. Recessed retainer front end 3q comprises surface 3h defining ink flow control path 18 connecting venting groove 17 and venting channel 16 with spiral ink flow path 3c.

This arrangement considerably reduces the height of the ink column between venting groove 17 and writing point 1 so that the capillary forces controlling the ink flow may be correspondingly reduced. Ink flow control path 18, which connects venting groove 17 to spiral ink flow path 3c, has the function of a valve formed by annular capillary 15 between the inner tubular front portion wall forming axial bore 2b and front end 3b of the floating weight retainer. Guide ribs 3i extend axially within the axial bore of the retainer along the entire length thereof for guiding floating weight 5 within the axial bore of the retainer during the axial movement thereof, two of the guide ribs 3i laterally delimiting venting channel 16 (see FIG. 4b) and the guide ribs defining a plurality of capillary annular segments 13. Annular capillary 15 is in communication, on the one hand, with the capillary annular segments and annular outlet bore 3m of spiral ink flow path 3c on the circumference of elongated tubular skirt 3b of retainer 3 and, on the other hand, with capillary slits 14 in front planar surface 3d of floating weight retainer 3, which capillaries are defined between abutment 2e of floating weight 5 and shallow grooves 3e in surface 3d. The front planar surface also has deep recess 3f.

Capillary connection 15 between capillaries 13 and 14 constitutes an ink flow control path 18 which is always filled with ink. This control path may be a groove but preferably is constituted by a segmental slit since the capillary forces will operate more effectively in a segmental slit and the sensitivity of the ink flow control system will thus be enhanced.

Particularly when the implement is used to write or draw heavy lines, care must be taken to provide a steady and uninterrupted flow of ink to tubular point 1 since an excessive withdrawal of ink from the point tends to produce a vacuum in ink reservoir 8 and this must be rapidly brought into equilibrium with the prevailing pressure in the ink flow path to avoid ink flow interruption. The venting channel 16 is of sufficient and constant cross section to assure this pressure equilibrium, and the balancing effect is enhanced by subdividing the channel into annular segments 13 by ribs 3i which also serve to center and guide floating weight 5 in retainer 3. This assures a steady ink flow and prevents the axially moving floating weight from being laterally displaced into the venting channel, the air passing rapidly along the floating weight. Guide ribs 3i also prevent air turbulence and bubbles in venting channel 16 so that ink will flow into the tubular drawing or writing point 1 even if air enters through venting groove 17 and control path 18 into venting channel 16 in the range of abutment 2e and ascends along the venting channel into ink reservoir 8 to establish a pressure equilibrium. In this manner, the system assures the rapid flow of air into the ink reservoir when the same is subjected to a loss of pressure due to the outflow of relatively large amounts of ink as well as when the system is subjected to excessive pressure due to raising the temperature of the air in ink reservoir 8. By positioning ink flow control path 18 in the range of floating weight abutment 2e, this is obtained without causing the formation of drops at point 1.

Ink reservoir or cartridge 8 is held in tubular body 9 of the implement and socket 4e of grip 4 extends into the tubular body for holding the cartridge in position. End 4d of grip 4 opposite to grip bore 4c is threaded for detachably fastening tubular body 9 to the grip. When the implement is in use, the ink flows from reservoir 8 through capillary slits 4f into transversely extending clearance 11 between floating weight retainer 3 and grip 4 whence it flows into annular clearance 12 defined between the retainer and the grip beyond threaded connection 2g, 3a between retainer 3 and tubular front portion 2. Retainer bottom 3k has capillary slits 31 and a bore permitting the ink to flow into channel 16 surrounding the floating weight and whence the ink flows into bore 1a of point 1 in the above-described manner. Floating weight 5 carries wire 7 projecting into axial bore 1a to carry the ink to the point. At the same time, the ink flows from channel 16 through connecting slot 2c in tubular front portion 2 into spiral path 2a formed along the circumference of the tubular front portion in axial bore 4a of the grip. Air vent 2h in tubular front portion 2 leads from grip bore 4a to spiral path 2a.

The ink flow and general functioning of a writing or drawing implement of the hereinabove-described type has been more fully set forth in my copending application Ser. No. 297,739 whose disclosure is incorporated herein by reference for a further understanding of the present invention.

What is claimed is:

1. In an ink writing implement comprising:

(a) a tubular front portion having an outer end holding a writing point, the tubular front portion having a circumference and defining an axial bore, a planar shoulder in the outer tubular front portion, the tubular front portion comprising (1) a spiral ink collecting system extending along the circumference of the outer tubular front portion, (b) a retainer tube for a floating weight defining an axial bore coaxial with the axial bore of the tubular front portion and having an annular planar surface facing the planar shoulder and in contact therewith, the retainer tube comprising (1) an elongated tubular portion having a circumference and extending through the tubular front portion bore, the tubular portion having an annular outer end engaging the shoulder, and (2) another spiral ink collecting system extending along the circumference of the tubular portion, the front end of the retainer tube being cylindrically recessed and the recessed retainer tube front end comprising a surface defining an ink flow control path in the axial bore of the tubular front portion, and (c) a floating weight guided for axial movement in the axial bore of the retainer tube, the floating weight defining an axially extending venting channel with the retainer tube, the improvement of (d) annular planar surface being pierced by a venting groove and capillary grooves extending along the surface, and (e) the planar shoulder of the tubular front portion forming an abutment for a front end of the floating weight, (f) the axial bore in the retainer tube being of sufficient length to accommodate the axial movement of the floating weight, and (g) the ink flow control path connecting the venting groove and channel with the spiral ink flow path.

2. The ink writing implement of claim 1, further comprising guide ribs extending axially within the axial bore of the retainer tube along the entire length thereof for guiding the floating weight within the axial bore of the retainer tube during the axial movement thereof, two of the guide ribs laterally delimiting the venting channel.

3. The ink writing implement of claim 2, wherein the guide ribs define a plurality of annular capillary segments forming the venting channel.

* * * * *